US008118390B2

(12) United States Patent
Pawlik

(10) Patent No.: US 8,118,390 B2
(45) **Date of Patent: *Feb. 21, 2012**

(54) MEDIA IDENTIFICATION SYSTEM WITH MOVING OPTOELECTRONIC DEVICE

(75) Inventor: Thomas D. Pawlik, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 458 days.

This patent is subject to a terminal disclaimer.

(21) Appl. No.: 12/332,670

(22) Filed: Dec. 11, 2008

(65) Prior Publication Data

US 2010/0149246 A1 Jun. 17, 2010

(51) Int. Cl.
*B41J 29/393* (2006.01)
*B41J 2/01* (2006.01)

(52) U.S. Cl. ..... 347/19; 347/101; 347/105; 347/106; 347/107

(58) Field of Classification Search ..... 347/19, 347/101, 105, 106, 107
See application file for complete search history.

(56) References Cited

U.S. PATENT DOCUMENTS

| | | | | |
|---|---|---|---|---|
| 6,291,829 | B1 * | 9/2001 | Allen et al. | 250/559.07 |
| 6,659,578 | B2 * | 12/2003 | Gudaitis et al. | 347/3 |
| 7,049,619 | B2 * | 5/2006 | Hahn et al. | 250/556 |
| 2002/0135628 | A1 | 9/2002 | Kolodziej | |
| 2003/0213924 | A1 | 11/2003 | Yamaguchi et al. | |
| 2006/0187441 | A1 | 8/2006 | Sugiyama et al. | |

FOREIGN PATENT DOCUMENTS

| | | | |
|---|---|---|---|
| FR | 2 786 758 | A1 | 6/2000 |
| WO | WO 2005/022127 | A2 | 3/2005 |

* cited by examiner

*Primary Examiner* — Ryan Lepisto
(74) *Attorney, Agent, or Firm* — Eugene I. Shkurko

(57) ABSTRACT

A printing system includes a carriage that is movable along a carriage scan direction and an optoelectronic device mounted on the carriage. A media input location, for storing a recording medium, is included along with at least one unobstructed optical path between the optoelectronic device and a plurality of regions of the media input location as the carriage is moved along the carriage scan direction.

16 Claims, 11 Drawing Sheets

MEDIA IDENTIFICATION SYSTEM WITH MOVING OPTOELECTRONIC DEVICE

CROSS REFERENCE TO RELATED APPLICATIONS

Reference is made to commonly assigned, co-pending U.S. Patent Applications:

U.S. patent application Ser. No. 12/332,722, filed herewith, entitled: "MOVABLE MEDIA TRAY WITH POSITION REFERENCE MARKS", by D. V. Brumbaugh et al., the disclosure(s) of which are incorporated herein by reference in their entirety; U.S. patent application Ser. No. 12/332,648, filed herewith, entitled: "MEDIA IDENTIFICATION SYSTEM WITH SENSOR ARRAY", by T. D. Pawlik et al., the disclosure(s) of which are incorporated herein by reference in their entirety; and U.S. patent application Ser. No. 12/332,616, filed herewith, entitled: "MEDIA MEASUREMENT WITH SENSOR ARRAY", by J. J. Haflinger et al.; the disclosures of which are incorporated herein by reference in their entirety.

FIELD OF THE INVENTION

The present invention relates generally to the field of printers, and in particular to identifying a type of recording medium that has been loaded into a printer.

BACKGROUND OF THE INVENTION

In order for a printing system (e.g. inkjet, electrophotographic, thermal, etc.) to print high quality images on a recording medium it is important to know what kind of media is about to be printed. In the case of inkjet, for instance, preferred recording conditions differ for different types of media, partly because different media interact differently with ink. An example of this is that ink is able to wick along the paper fibers in plain paper, so that the spot of ink on the paper is enlarged and irregularly shaped relative to the drop of ink that strikes the paper. Media, which are specially formulated for high quality images, such as photographs, typically have an ink-receiving layer that absorbs the ink in a more controllable fashion, so that the spot size and shape are more regular. Because the colorants are trapped closer to the paper surface, and because a larger quantity of ink can be printed, (the associated carrier fluids being absorbed), an image printed on photographic print media has more vibrant colors than the same image printed on plain paper.

The appropriate amount of ink to use for printing an image on one type of medium is different than printing on another type of medium. If plain paper receives the same quantity of ink, more appropriately deposited in order to print a high-density image such as a photo that would be used for that same image on photographic print medium, the plain paper may not be able to dry quickly enough. Even worse, the plain paper may cockle or buckle in the presence of excess ink, so that the printhead crashes into the printed image, thus smearing the image, and possibly damaging the printhead as well. Even for two different types or grades of photographic print media, the amount of ink or number of passes to lay down an image for good tradeoffs in printing quality and printing throughput will be different. It is, therefore, important when receiving image-related data on a specific image to be printed, that the specific image be rendered appropriately for a specific media type that the image will be printed on. Image rendering is defined herein as determining data corresponding to: a) the appropriate amount of ink to deposit at particular pixel locations of the image; b) the number of multiple passes needed to lay the ink down on the medium in light of ink-to-ink and ink-to-medium interactions; and c) the type of pattern needed to produce the image.

Various means are known in the art for providing information to the printer or to an associated host computer regarding the type of medium (e.g. glossy media or matte media of various grades, or plain paper), that is in the input tray of the printer. For example, the user may enter information on media type. Alternatively, there can be a barcode or other type of code pattern printed on the backside of the medium that is read to provide information on media type as a sheet of medium is picked from the input tray and fed toward the printing mechanism. Alternatively, media characteristics such as optical reflectance can be used to distinguish among media types. Generally, the processes for automatic media type detection require several seconds to provide accurate media-related information on media type. For competitive printers today, it is important to achieve excellent print quality at fast printing throughput. In particular, a user may be dissatisfied if the time required to print the first page of a print job is excessive.

U.S. Pat. No. 6,830,398 discloses one method providing faster printing throughput while enabling automatic media type detection prior to controlling conditions in the printing operation. In U.S. Pat. No. 6,830,398, a load detector is provided for detecting that recording medium has been loaded into the printer. In addition, there is provided a sensor, such as a reflective optical sensor, that can discriminate the type of media type after the medium has been loaded into the recording medium loading section, but before paper feeding starts. In U.S. Pat. No. 6,830,398, when the printer is turned on, or after medium loading has been detected, the sensor obtains information about the medium type, even before the first page of medium is picked for feeding to print a print job. However, conventional printers do not have a sensor capable of reliably discriminating paper type as described in U.S. Pat. No. 6,830,398. For example, the sensor in U.S. Pat. No. 6,830,398 would have difficulty discriminating between matte paper versus plain paper. To date, it has been found that improved reliability of media type detection is provided when the sensor (such as an optical reflective sensor) provides information regarding a plurality of regions of the recording medium.

U.S. Pat. No. 7,120,272; includes a sensor that makes sequential spatial measurements of a recording medium moving relatively to the sensor, where the recording medium contains repeated indicia to determine a repeat frequency and repeat distance of the indicia. The repeat distance is then compared against known values to determine the type of recording medium present.

In a carriage printer, such as an inkjet carriage printer, a printhead is mounted in a carriage that is moved back and forth across the region of printing. To print an image on a sheet of paper or other recording medium (also interchangeably referred to as paper or media herein), the recording medium is advanced a given distance along a recording medium advance direction and then stopped. While the recording medium is stopped and supported on a platen in a print zone relative to the printhead carriage, the printhead carriage is moved in a direction that is substantially perpendicular to the recording medium advance direction as marks are controllably made by marking elements on the recording medium, for example, by ejecting drops from an inkjet printhead. After the carriage has printed a swath of the image, while traversing the recording medium; the recording medium is advanced, the carriage direction of motion is reversed, and the image is formed swath by swath.

Commonly assigned co-pending U.S. patent application Ser. Nos. 12/037,970 and 12/250,717, disclose methods for identifying a general type of recording medium (e.g. photo paper versus plain paper) by analyzing a signal from a photosensor that is mounted on the printhead carriage. However, these co-pending patent applications disclose waiting until the recording medium is advanced into the print zone to scan the recording medium with the photosensor. This can increase the time required before the first print is available.

U.S. patent application Ser. No. 12/047,359, discloses a method for identifying a type of recording medium by using identification marks provided on the recording medium, for example on its backside. An embodiment described therein uses the motion of the recording medium as it is being picked from the media input tray in order to move the identification marks past a sensor. In other words, this U.S. Patent Application discloses waiting until a print job is initiated and the recording medium is being picked. This can increase the time required before the first print is available. Special methods for identifying locations of marks are also disclosed in U.S. patent application Ser. No. 12/047,359, in order to compensate for errors in measuring spacings between marks that are due, for example, to media slippage during advance of the recording medium.

What is needed, is a way to reliably identify a type of recording medium at a media input location in a printing system before a print job is initiated.

SUMMARY OF THE INVENTION

The aforementioned need is met by providing a printing system that includes a carriage movable along a carriage scan direction with an optoelectronic device mounted on the carriage. A media input location, for storing a recording medium, is included along with at least one unobstructed optical path between the optoelectronic device and a plurality of regions of the media input location as the carriage is moved along the carriage scan direction.

Another aspect of the present invention provides a method for identifying a type of recording medium that is stored in a media input location of a printing system, the method includes the following steps:

providing a carriage that is movable along a carriage scan direction;

providing an optoelectronic device that is mounted on the carriage;

providing at least one unobstructed optical path between the optoelectronic device and a plurality of regions of the media input location as the carriage is moved along the carriage scan direction;

providing a printing system controller including a table of characteristics of a plurality of recording media types;

activating the optoelectronic device while the carriage is moving along the carriage scan direction in order to provide a time-varying electronic signal corresponding to a plurality of regions of the input location;

transmitting the time-varying electronic signal to the printing system controller; and comparing the time-varying electronic signal to the table of characteristics for identifying the type of recording medium that is stored in the media input location of the printing system.

DETAILED DESCRIPTION OF THE INVENTION

Figure 1:
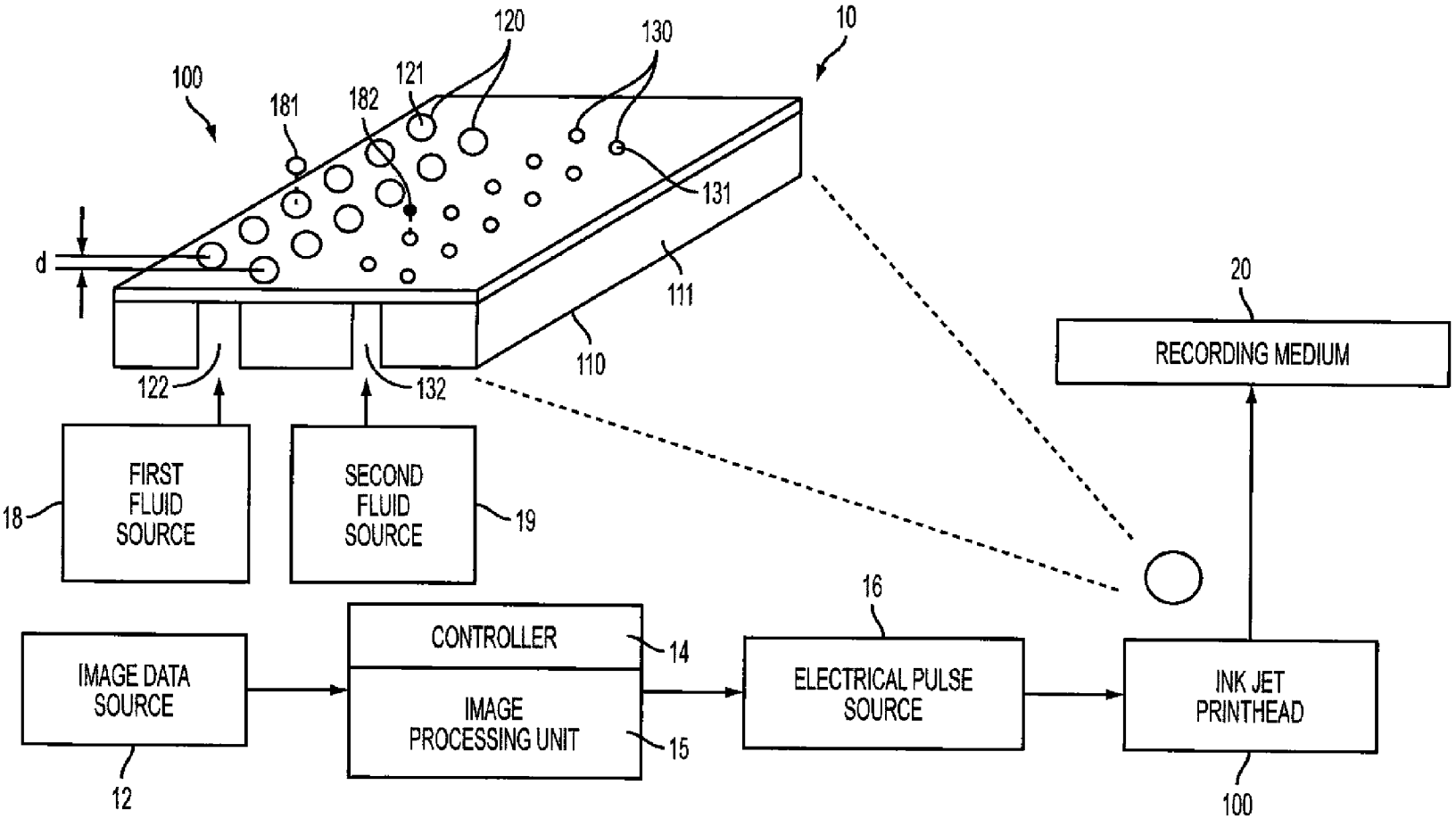
FIG. 1 PRIOR ART
FIG. 1 is a schematic representation of an inkjet printer system.

Referring to FIG. 1, a schematic representation of an inkjet printer system 10 is shown, as described in U.S. Pat. No. 7,350,902, and incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles in the first array 121, in the first nozzle array 120, have a larger opening area than nozzles in the second array 131, in the second nozzle array 130. In this example, each of the two nozzle arrays (120 and 130) has two staggered rows of nozzles, each row having a nozzle density of 600 per inch. The effective nozzle density then in each array is 1200 per inch. If pixels on the recording medium 20 were sequentially numbered along the media advance direction 304, the nozzles from one row of an array would print the odd numbered pixels, while the nozzles from the other row of the array would print the even numbered pixels.

In fluid communication with each nozzle array is a corresponding ink delivery pathway 132. Ink delivery pathway 122 is in fluid communication with first nozzle array 120, and ink delivery pathway 132 is in fluid communication with second nozzle array 130. Portions of ink delivery pathways 122 and 132 are shown in FIG. 1 as openings through printhead die substrate 111. One or more inkjet printhead die 110 will be included in inkjet printhead 100, but only one inkjet printhead die 110 is shown in FIG. 1. The inkjet printhead die 110 are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 (first and second, respectively) are shown, in some applications, it may be beneficial to have a single ink source supplying ink to nozzle arrays 120 and 130 via ink delivery pathways 122 and 132 (first and second, respectively). Also, in some embodiments, fewer than two or more than two nozzle arrays may be included on inkjet printhead die 110. In some embodiments, all nozzles on an inkjet printhead die 110 may be the same size, rather than having multiple sized nozzles on an inkjet printhead die 110.

Not shown in FIG. 1, are the drop forming mechanisms associated with the nozzles. Drop-forming mechanisms can be of a variety of types, some of which include a heating element to vaporize a portion of ink and thereby cause ejection of a droplet, or a piezoelectric transducer to constrict the volume of a fluid chamber and thereby cause ejection of a droplet, or an actuator which is made to move (for example, by heating a bi-layer element) and thereby cause ejection of a droplet. In any case, electrical pulses from electrical pulse source 16 are sent to the various drop ejectors according to the desired deposition pattern. In the example of FIG. 1, droplets ejected from first nozzle array 181, ejected from first nozzle array 120 are larger than droplets ejected from the second nozzle array 182, ejected from second nozzle array 130; due to the larger nozzle opening area. Typically, other aspects of the drop-forming mechanisms (not shown) associated respectively with nozzle arrays 120 and 130 (first and second, respectively) are also sized differently, in order to optimize the drop ejection process for the different sized droplets. During operation, droplets of ink are deposited on a recording medium 20.

Figure 2:
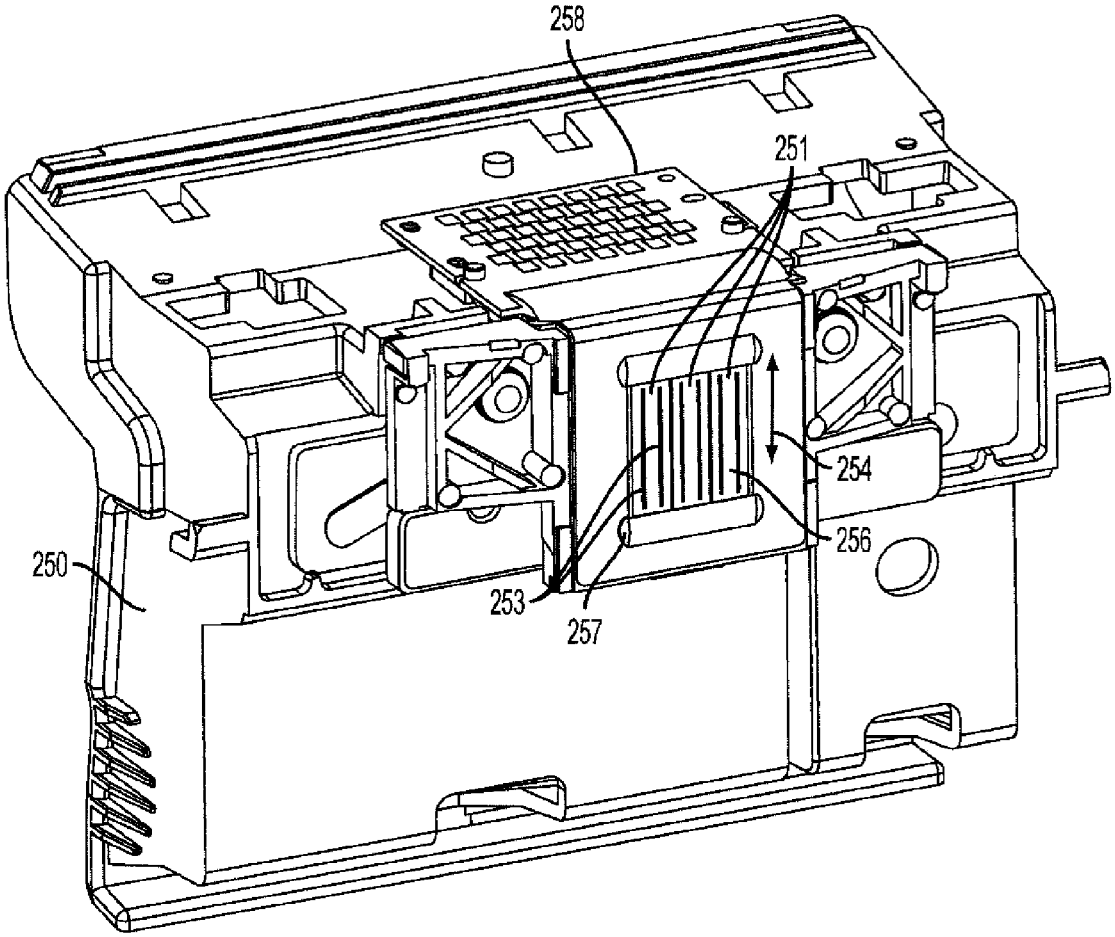
FIG. 2 PRIOR ART
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to inkjet printhead die 110), each printhead die 251 containing two nozzle arrays 253, so that printhead chassis 250, contains six nozzle arrays 253, altogether. The six nozzle arrays 253, in this example, may each be connected to separate ink sources (not shown in FIG. 2), such as: cyan, magenta, yellow, text black, photo black, and a colorless protective printing fluid. Each of the six nozzle arrays 253 is disposed along direction 254, and the length of each nozzle array 253 along direction 254 is typically on the order of 1 inch or less. Typical lengths of recording media are 6 inches for photographic prints (4 inches by 6 inches), or 11 inches for paper (8.5 inches by 11 inches). Thus, in order to print the full image, a number of swaths are successively printed while moving printhead chassis 250 across the recording medium 20. Following the printing of a swath, the recording medium 20 is advanced along a media advance direction 304 that is substantially parallel to nozzle array direction 254.

Also shown in FIG. 2 is a flex circuit 257, to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
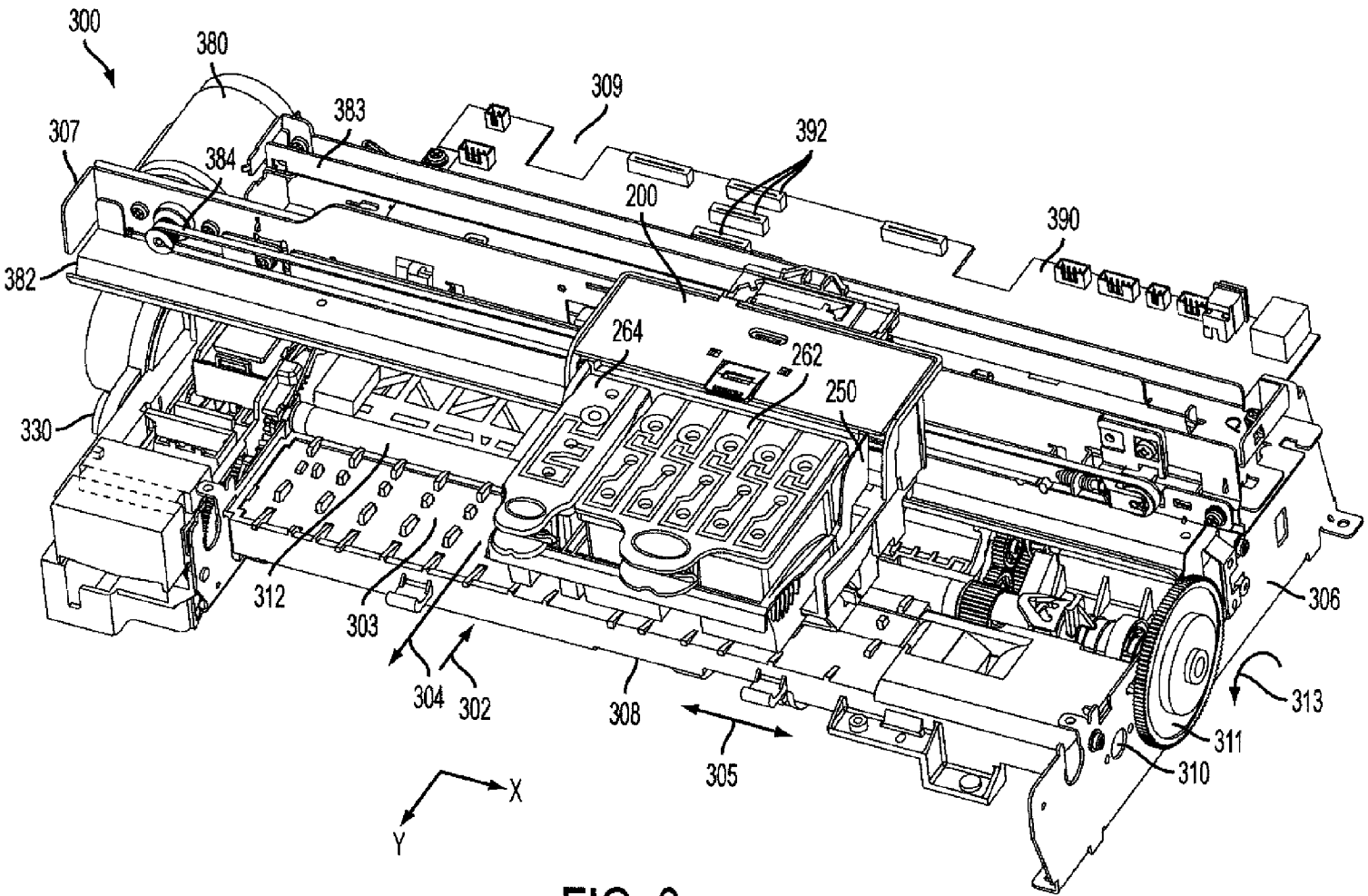
FIG. 3 PRIOR ART
FIG. 3 is a perspective view of a portion of a carriage printer.

FIG. 3 shows a portion of a desktop carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Figure 4:
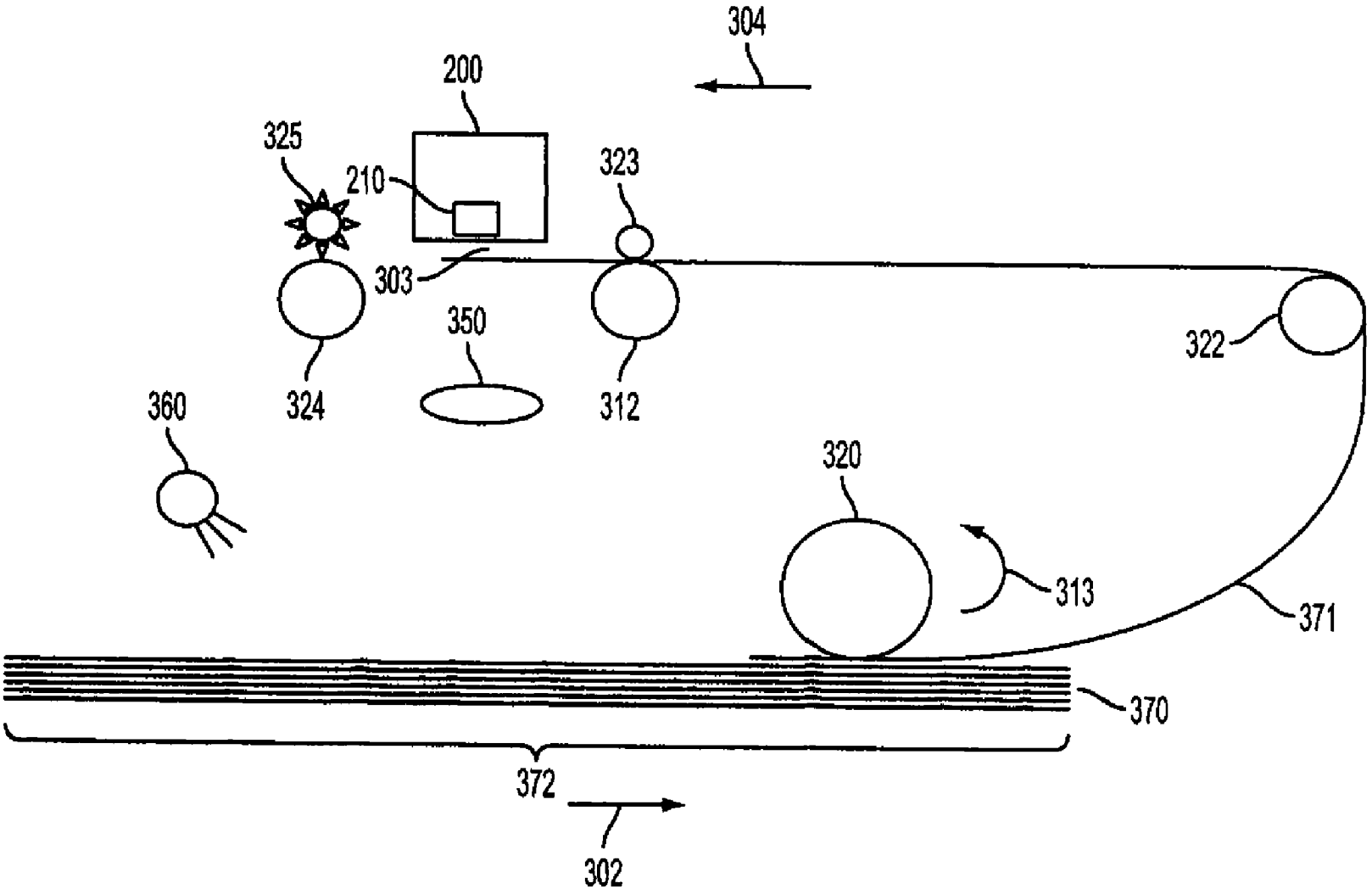
FIG. 4 is a schematic side view of a paper path in a carriage printer.

Also mounted on carriage 200 is a carriage-mounted optoelectronic device 210, as shown schematically in FIG. 4. Carriage-mounted optoelectronic device 210 includes at least one device that either converts an electronic signal to emitted light or converts light impingent on the optoelectronic device into an electronic signal. Examples of such optoelectronic devices include LED's and photosensors, respectively. In some embodiments, carriage-mounted optoelectronic device 210 includes both a light emitter such as an LED that shines light onto the recording medium 20, and a photosensor 212 that receives light reflected from the recording medium 20.

Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 are located at the bottom side of printhead chassis 250; the droplets of ink being ejected downward onto the recording medium 20 in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording media (sometimes generically referred to as paper or media herein), is loaded along paper load entry direction 302 toward the front 308 of printer chassis 300.

A variety of rollers are used to advance the medium through the printer, as shown schematically in the side view of FIG. 4. In this example, a pick-up roller 320 moves the top sheet of medium 371 of a stack of recording media 370 of paper or other recording media from the media input location 372 in the direction of arrow 302. The media input location can be an input tray, for example. A turn roller 322 acts to move the paper around a C-shaped path (in cooperation with a curved rear wall surface) so that the paper continues to advance along media advance direction 304 from the rear 309 of the printer (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 may consist of a separate roller mounted on the feed roller shaft, or may consist of a thin, high-friction coating on the feed roller shaft.

The motor that powers the paper advance rollers is not shown in FIG. 1, but the hole 310 at the right side of the printer chassis 306, is where the motor gear (not shown) protrudes through in order to engage feed roller gear 311, as well as the gear for the discharge roller (not shown). For normal paper pick-up and feeding, it is desired that all rollers rotate in forward rotation direction 313, toward the left side 307, in the example of FIG. 3, is the maintenance station 330.

Toward the rear 309 of the printer in this example is located the printer electronics board 390, which contains cable connectors 392 for communicating via cables (not shown) to the printhead carriage 200 and from there to the printhead. Also, on the printer electronics board 390 are typically mounted motor controllers for the carriage motor 380; and for the paper advance motor, a processor and/or other control electronics (shown schematically as controller 14 and image processing unit 15 in FIG. 1), for controlling the printing process, and an optional connector for a cable to a host computer.

For the C-shaped paper path shown in FIG. 4, the stack of recording media 370 is loaded backside, facing up at media input location 372. The backside of a sheet of medium is defined as the side of the sheet that is not intended for printing. Specialty media such as those having glossy, luster, or matte finishes for different quality media, may be marked on the backside by the medium manufacturer to identify the media type. In addition to information on printing surface finishes, marking code patterns can provide information in regards to the thickness, length, width, orientation, etc., of the recording medium 20.

Unlike examples disclosed in U.S. patent application Ser. No. 12/047,359, where the media manufacturer's markings are detected by a backside media sensor located near the media input location 372; embodiments of the present application use the one or more optoelectronic devices in carriage-mounted optoelectronic device 210 to provide a time-varying electronic signal corresponding to a plurality of regions of a sheet of medium (e.g. top sheet of medium 371) in the media input location 372. Although examples disclosed in U.S. patent application Ser. No. 12/047,359, rely on the motion of top sheet of medium 371 as it is being picked from stack of recording media 370 at media input location 372 in order to bring a plurality of regions of the top sheet of medium 371 past the field of view of the backside media sensor, embodiments of the present invention rely on motion of carriage-mounted optoelectronic device 210 to bring a plurality of regions of top sheet of medium 371 past a field of view of a photosensor 212 to provide a time-varying electronic signal.

Figure 5:
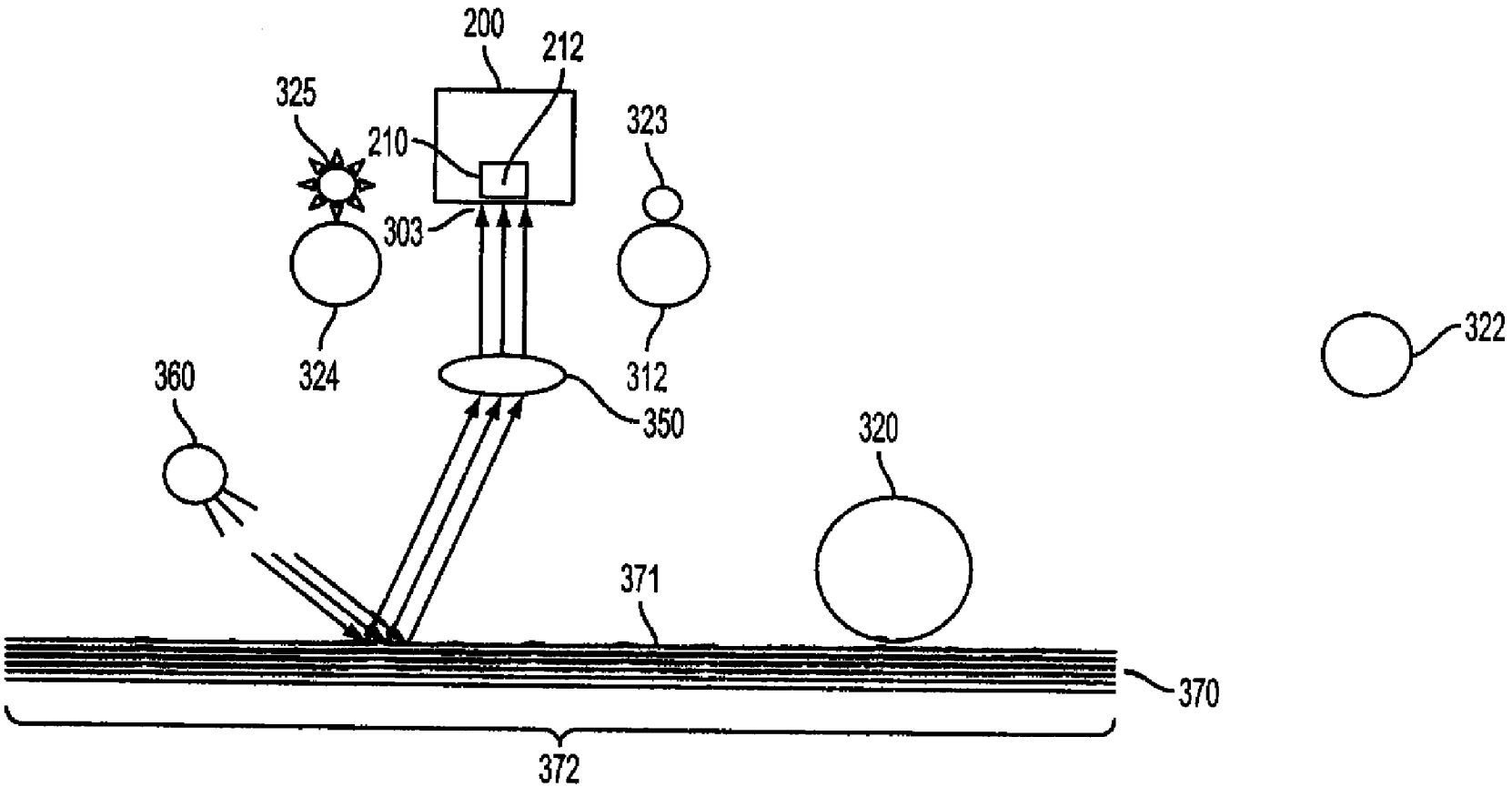
FIGS. 5, 6, and 7 are schematic side views of embodiments of media identification using a photosensor that is mounted on the carriage.

FIG. 5 shows the same view as in FIG. 4 however, the top sheet of medium 371 is still at media input location 372. A light source 360 illuminates a portion of the top sheet of medium 371. (While the word "light" is used herein, the term is not meant to exclude wavelengths outside the visible spectrum.) Although, in some exemplary embodiments (FIGS. 5 through 7), the light source 360 can be separate from carriage-mounted optoelectronic device 210. In other embodiments, such as the one shown in FIG. 8, light source 360 can be mounted on carriage 200, as a LED or laser diode for example. In FIGS. 5 through 8, optoelectronic device 210 includes a photosensor(s) 212.

FIGS. 5 through 8, show light paths (also called optical paths) indicated by arrows from light source 360 to the top sheet of medium 371 at a media input location 372 to the photosensor(s) 212 that is mounted on the carriage-mounted optoelectronic device 210. The light paths shown in FIGS. 5 through 8 are only meant to be schematic representations and are not directionally or dimensionally precise. The optical path can include optical elements such as a lens 350, and/or a mirror(s) 362 (as in FIG. 6), and/or a beam splitter 364 (as in FIG. 7), and/or an aperture 214 (as in FIG. 9); to properly direct light from the light source 360 to the media input location 372 and from there to the photosensor(s) 212, such that an unobstructed optical path is provided and stray light is shielded from the photosensor(s) 212. In other words, a region of the top sheet of medium 371 is within the field of view of the photosensor(s) 212, and that field of view is not blocked substantially. After the top sheet of medium 371 has been advanced into the printing region 303 (as in FIG. 4), the optical path between the light source 360, the media input location 372, and the photosensor(s) 212; it may be blocked by the top sheet of medium 371, but prior to advancing of the top sheet into the printing zone, where the optical path is unobstructed (as in FIGS. 5 through 8).

As the carriage 200 moves along the carriage scan direction 305 (into and out of the plane of FIGS. 5 through 8), a plurality of unobstructed optical paths between the photosensor(s) 212 and the media input location 372 allow identification of the type of recording medium by spatially-varying characteristics on its surface, such as manufacturer's code markings. Photosensor(s) 212 is activated by receiving light to provide an electronic signal. The photosensor signal is larger when more light is received, so that as the carriage 200 is moved along the scan direction and different regions of the recording medium enter the field of view of photosensor(s) 212, a time-varying electronic signal is provided. For the case where the anchor bars and identification marks absorb light to a greater extent than the backside media surface, when the backside surface of the media is in the field of view (without other markings), the photosensor signal will be approximately at a high, background level. When anchor bars, identification marks, logos, or other markings enter the field of view of the photosensor, the photosensor signal decreases. When a mark is fully in the field of view of the photosensor, the photosensor signal is at a relative low point. (Note: Subsequent signal processing can result in such low points being peaks rather than valleys in the signal, and they will generally be referred to as peaks herein.) A characteristic, spatially-varying set of manufacturer's markings, provide a characteristic time-varying output signal from photosensor(s) 212, where the time variation of the signal is related to the spatial variation of the markings through the velocity of the carriage.

For embodiments including a lens 350 in the optical path, the lens 350 can also be attached to the carriage 200 such that it moves along with optoelectronic device 210. For embodiments where the attached lens 350 or portions of optoelectronic device 210 prevent the free movement of carriage 200, the lens 350 or other motion-obstructing portions, can be pivotally mounted on carriage 200, so that they can be moved out of the way during printing. Alternatively, lens 350 can be a cylindrical lens that is stationarily mounted above media input location 372 with the cylinder axis being substantially parallel to the carriage scan direction 305.

Figure 8:
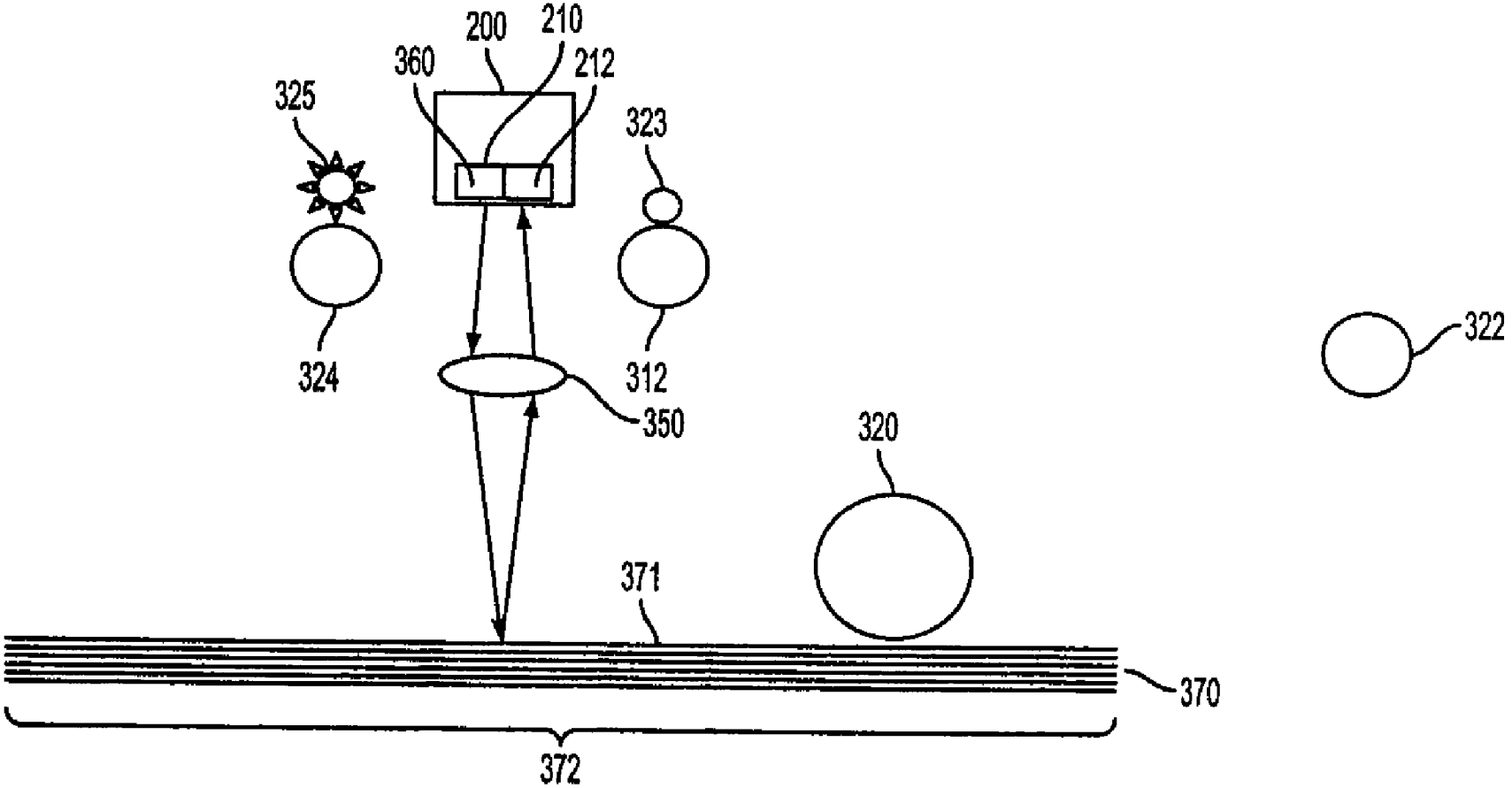
FIG. 8 is a schematic side view of an embodiment of media identification using a light emitter and photosensor that are mounted on the carriage.
Figure 9:
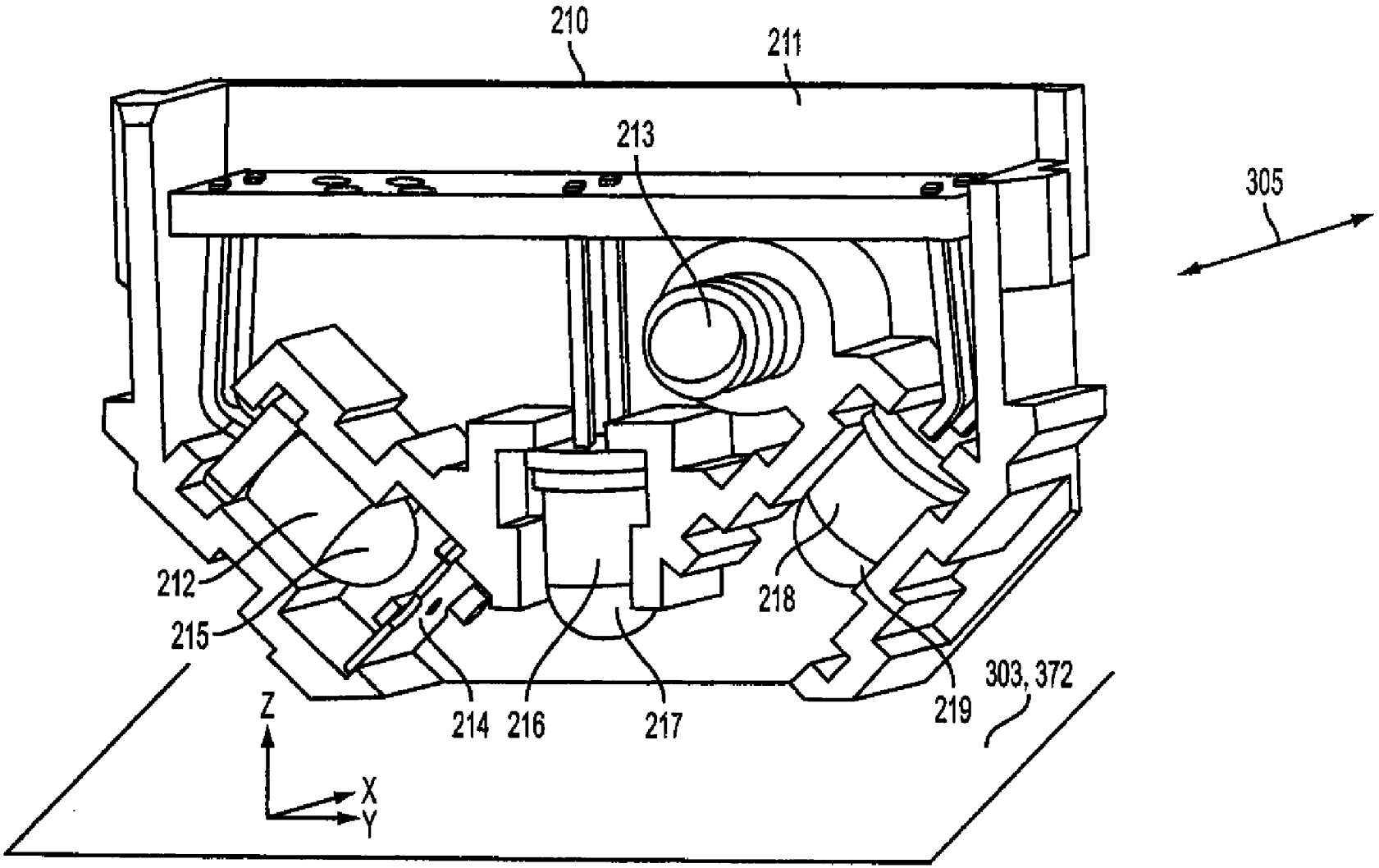
FIG. 9 is a perspective view of a carriage mounted sensor including both a light source and a photosensor.

FIG. 9 is a perspective view of carriage-mounted optoelectronic device 210 that can be used in embodiments of the present invention such as the example shown in FIG. 8, where the light source 360 and the photosensor(s) 212 are both mounted on carriage 200. Such a carriage sensor and its associated uses are described more completely in U.S. patent application Ser. No. 12/037,966. FIG. 9 shows a perspective view of the carriage-mounted optoelectronic device 210, the frame 211, of which may be attached to carriage 200 by bolt 213, for example. Also shown in carriage-mounted optoelectronic device 210, are photosensor 212, aperture 214, first LED 216, and second LED 218. The photosensor 212 and the two LED's 216 and 218 are semiconductor devices (not shown), that are encapsulated in optically clear materials (transmissive to light at the wavelength of interest) that form lenses 215, 217, and 219, respectively. Photosensor lens 215 helps to focus light received through aperture 214 onto the photosensor device, while lenses 217 and 219 help to direct the emitted light toward the plane of the recording medium. Photosensor 212 is a particular example of photosensor(s) 212, and LED's 216 and 218 are particular examples of light source 360 (as shown in earlier figures).

FIG. 9 shows an orientation of carriage-mounted optoelectronic device 210 that is appropriate for an embodiment in which recording medium either in the print region 303 or in the media input location 372 is located horizontally below the printhead 250 and the carriage-mounted optoelectronic device 210, which are mounted on carriage 200. First LED 216 is oriented to emit light vertically downward, i.e. substantially normal to the plane of the recording medium in both the print region 303 and in the media input location 372. Photosensor 212 is configured to be on one side of first LED 216, and photosensor 212 is oriented to receive light along a direction that is at an angle of about 45 degrees with respect to the normal to the plane of the recording medium (and pointing toward the back of the printer so that it does not receive external stray light) in this example. Second LED 218 is configured to be on the other side of first LED 216, and second LED 218 is oriented to emit light at substantially the same angle with respect to the normal, as the photo sensor 212, but on the other side of the normal. In this example, second LED 218 is oriented to emit light along a direction that is around 45 degrees from the normal to the plane of the recording medium in the print zone. In other examples, the angle between the normal and the photosensor 212 on one side and second LED 218 on the other side can range between 30 degrees and 60 degrees, but the angle for each should be the same. Thus, in this example, the two LED's (216 and 218, respectively) are aligned, by the optoelectronic device package, relative to the photosensor 212 such that the photosensor 212 receives specular reflections of light incident on the recording medium from second LED 218; and photosensor 212 receives diffuse reflections of light incident on the recording medium from first LED 216. Photosensor 212 provides an output signal (typically an output current) corresponding to the amount of light that strikes the photosensor 212. In various embodiments, either specular reflection or diffuse reflection of light can be used to identify the type of recording medium.

Aperture 214 allows light that is incident within a range of angles to enter the photosensor 212, thus providing a field of view of the backside of the medium in the media input location 372. The aperture 214 helps to shield the optical path to the photosensor in order to block stray light that has not been reflected from the medium at the media input location 372, and also limits the field of view to a small region on the order of several tenths of a millimeter to several millimeters in extent.

The light signal reflected from the manufacturer's marking is different from the light signal on the rest of the backside of the medium, so that different spacings of identification bars, for example, may be detected as different spacings of peaks or valleys of the photosensor signal. In some examples, the markings may be made using an IR absorbing material, and the light source 360 can be an infrared light source, so that light reflected from the manufacturer's markings produces a lower amplitude signal in photosensor(s) 212 than if the field of view only includes unmarked portions of medium. In other examples, fluorescent materials can be used to provide the marking information rather than light absorbing materials. In such examples, relative interaction between the light emitted from the LED and the markings or the rest of the backside of the medium, can be different. Rather than absorbing light to a greater extent than the rest of the medium, the fluorescing information markings can provide greater light to the photosensor than the rest of the medium. In general, the photosensor signal corresponding to the information markings is different from the photosensor signal corresponding to the rest of the backside surface of the medium. Embodiments for using fluorescence detection typically include an optical filter (not shown) in the reflected light path to exclude the excitation light.

Figure 10B:
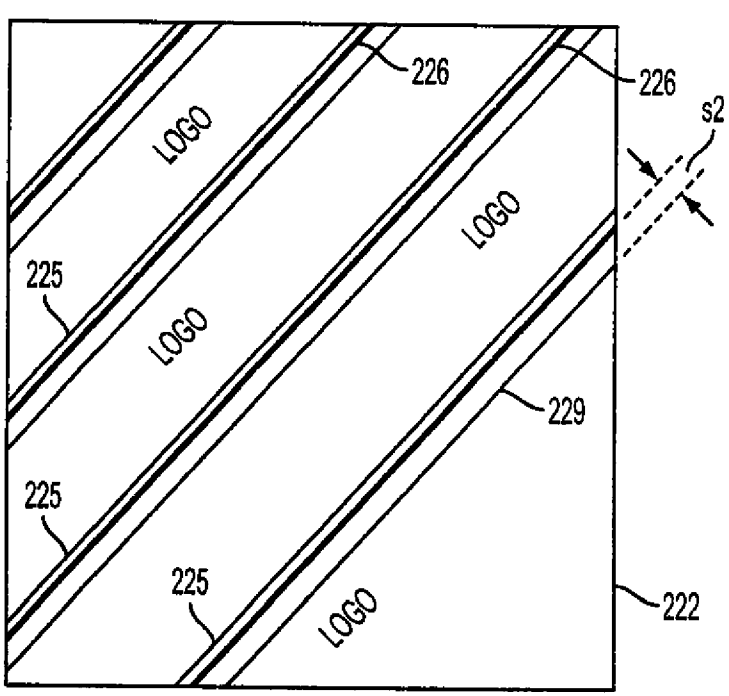
FIGS. 10*a* and 10*b* show schematic representation of markings on the backside of a first type of recording medium and a second type of recording medium respectively.
Figure 10A:
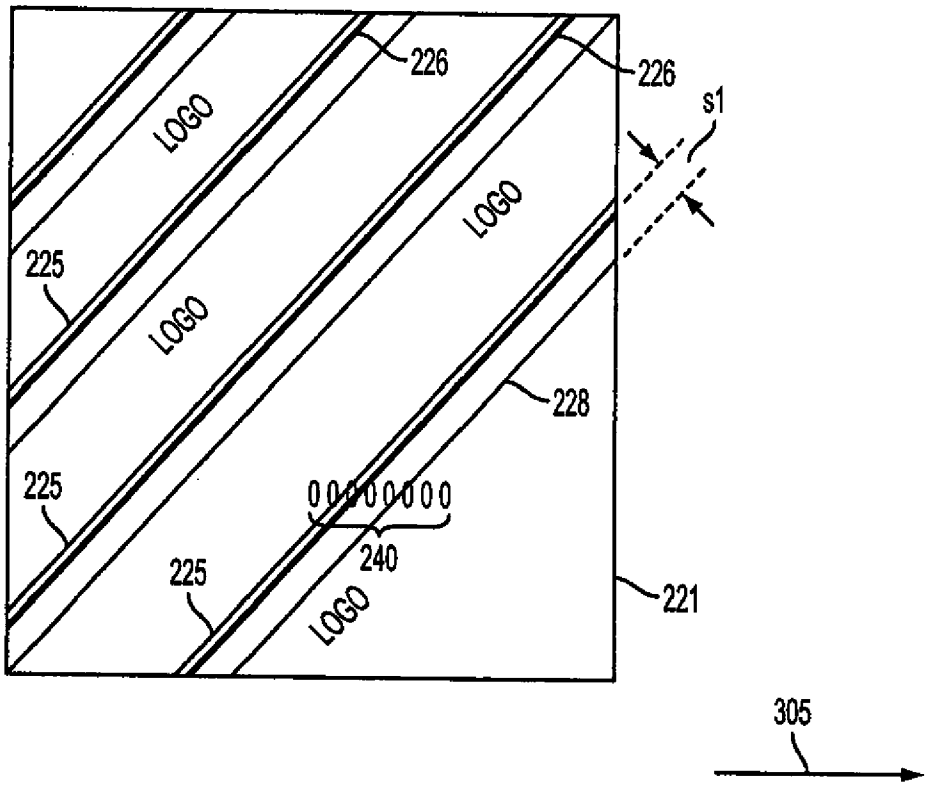

FIGS. 10*a* and 10*b* show schematic representation of markings on the backside of a first type of recording medium and a second type of recording medium, respectively. In this embodiment, each of the various types of recording media has a reference marking consisting of a pair of "anchor bars" 225 and 226, which are located at a fixed distance with respect to one another for all media types. In addition, there is a first identification mark 228 on the first media type 221 in FIG. 10*a*, and there is a second identification mark 229 on the second media type 222 in FIG. 10*b*. In this example, first identification mark 228 is spaced a distance s1 away from second bar of anchor bar pairs 226 on first media type 221, and second identification mark 229 is spaced a distance s2 away from second bar of anchor bar pairs 226 on second media type 229, such that s1 does not equal s2. Thus, in this example, it is the spacing of the identification mark from one of the anchor bars that identifies the particular type of recording medium.

Ovals 240 in FIG. 10*a*, schematically represent the field of view of previously described photosensor(s) 212 in optoelectronic device 210 as the carriage 200 is scanned relative to first type recording medium 221 in media input location 372. Because the field of view 240, of the photosensor(s) 212, moves along the carriage scan direction 305 as the carriage 200 moves, it is actually the projections of marking spacings s1 and s2 along carriage scan direction 305 that are measured. Photosensor data is actually sampled much more frequently than the ovals 240, shown in FIG. 10*a*, but only a few samples are shown for clarity. In addition, the actual field of view can be a different size or shape than the ovals 240, shown in FIG. 10*a*, as determined; for example, by aperture 214 shape, the angle of the aperture plane relative to the plane of the recording medium, optical elements such as lenses, and optical path lengths.

The photosensor output signal can be amplified and filtered to reduce background noise and then digitized in an analog to digital converter. Once the amplified photosensor signal has been digitized, digital signal processing can be used to further enhance the signal relative to high frequency background noise. In addition, the time-varying signal can be converted into spatial distances to find peak widths or distances between peaks corresponding to the code pattern markings.

With reference to FIGS. 10*a* and 10*b*, suppose the spacings s1 and s2, as projected along carriage scan direction 305, are 0.4 inch and 0.2 inch, respectively. If the carriage sensor assembly is scanned at a speed of 10 inches per second, then the interval of time corresponding to those projected spacings would be 0.04 second and 0.02 second, respectively, giving rise to signal peaks at those intervals.

The same linear encoder fence 383 (as in FIG. 3) that is used by the carriage printer to let the controller 14 know the location of the printhead during printing can be used to interpret the position of the carriage sensor during scanning. A typical linear encoder has a resolution of R=600 transitions per inch (0.0017 inch). This resolution is sufficient to distinguish media marking spacings such as 0.2 inch and 0.4 inch. In addition, because the recording medium is not being moved during media type identification, and because the carriage location can be precisely located by the linear encoder fence 383, embodiments of the present invention are not susceptible to motion inaccuracies such as media slippage.

A table of media surface characteristics is stored in printer memory in printing system controller 14 for comparison with the photosensor data. For identifying media type by manufacturer's markings, the time-varying photosensor data peaks can be used if a standard carriage velocity, corresponding to the velocity used in preparing the table is used for scanning the photosensor(s) 212. Alternatively, the data can be compared in terms of spatial distances, by use of the linear encoder as described above. In any case, the table includes characteristics corresponding to a plurality of media types, and the electronic signal from the photosensor(s) 212 is compared to the characteristics in the table, in order to identify the type of recording medium that is stored in the media input location 372.

As sheets of medium are removed from or added to stack of recording media 370 as shown in FIGS. 5 through 8, in some embodiments, the distance between top sheet of medium 371, the lens 350, and photosensor(s) 212 is held constant; for example, by moving a media tray up and down. However, in other embodiments, removing or adding media causes the distance between top sheet of medium 371, the lens 350, and photosensor(s) 212 to change. In such embodiments, the depth of field of the optical imaging path to the photosensor should be designed such that whether stack of recording media 370 is full, or only has one sheet, the surface of the top sheet of medium 371 is still sufficiently in focus for providing photosensor data that can be meaningfully compared to the table of values stored in printer memory. Depth of field can be increased, for example, by decreasing the size of aperture 214. If the manufacturer's markings are slightly out of focus, the peaks corresponding to markings can be broadened; but the centers of two peaks should remain at the same spacing, so a measurement of center-to-center peak spacings can provide data that is less sensitive to media stack height than a measurement of peak widths, for example.

An example of the embodiment shown in FIG. 5, was built using an infrared LED (880 nm) as light source 360. Carriage mounted photosensor(s) 212 was a 0.5 $mm^2$ photodiode with an integrated amplifier and a visible light exclusion filter. Lens 350 had a focal length of 20 mm. For manufacturer's markings consisting of an IR absorbing barcode, it was found that the photodetector output voltage decreased by 15 percent at the peak.

For the C-shaped paper path, shown in FIGS. 4 through 8, the recording medium at the media input location 372 is stacked printing-side down so that the backside of the recording medium is visible. Thus, in the above embodiments, the recording medium type is identified by characteristics (e.g. code markings) on the backside of the recording medium. For a printing system having a paper path where the paper is moved directly to the printing process without turning the paper over, the recording medium is stacked printing-side up at the media input location 372. Embodiments of the present invention in such cases include using printing surface optical reflection characteristics for different types of recording media (e.g. glossy paper versus plain paper), as described in U.S. patent application Ser. Nos. 12/037,970 and 12/250,717; but using the carriage mounted photosensor to detect reflection characteristics while the recording medium is at the media input location 372 rather than at the printing zone.

In some embodiments, even if the recording medium at the media input location 372 is stacked printing side down, it may be possible to detect manufacturer's code markings on the printing side. Such embodiments can be implemented if the recording medium is sufficiently transmissive, the light source 360 is sufficiently intense, and/or the contrast provided between the markings and the background is sufficiently high. Furthermore, if markings are used that are invisible to the human eye, such as IR absorptive or UV fluorescent markers, the embodiment of the present invention could detect manufacturer's code markings on both sides of the media. This is particularly useful for identifying double-sided media.

Figure 6:
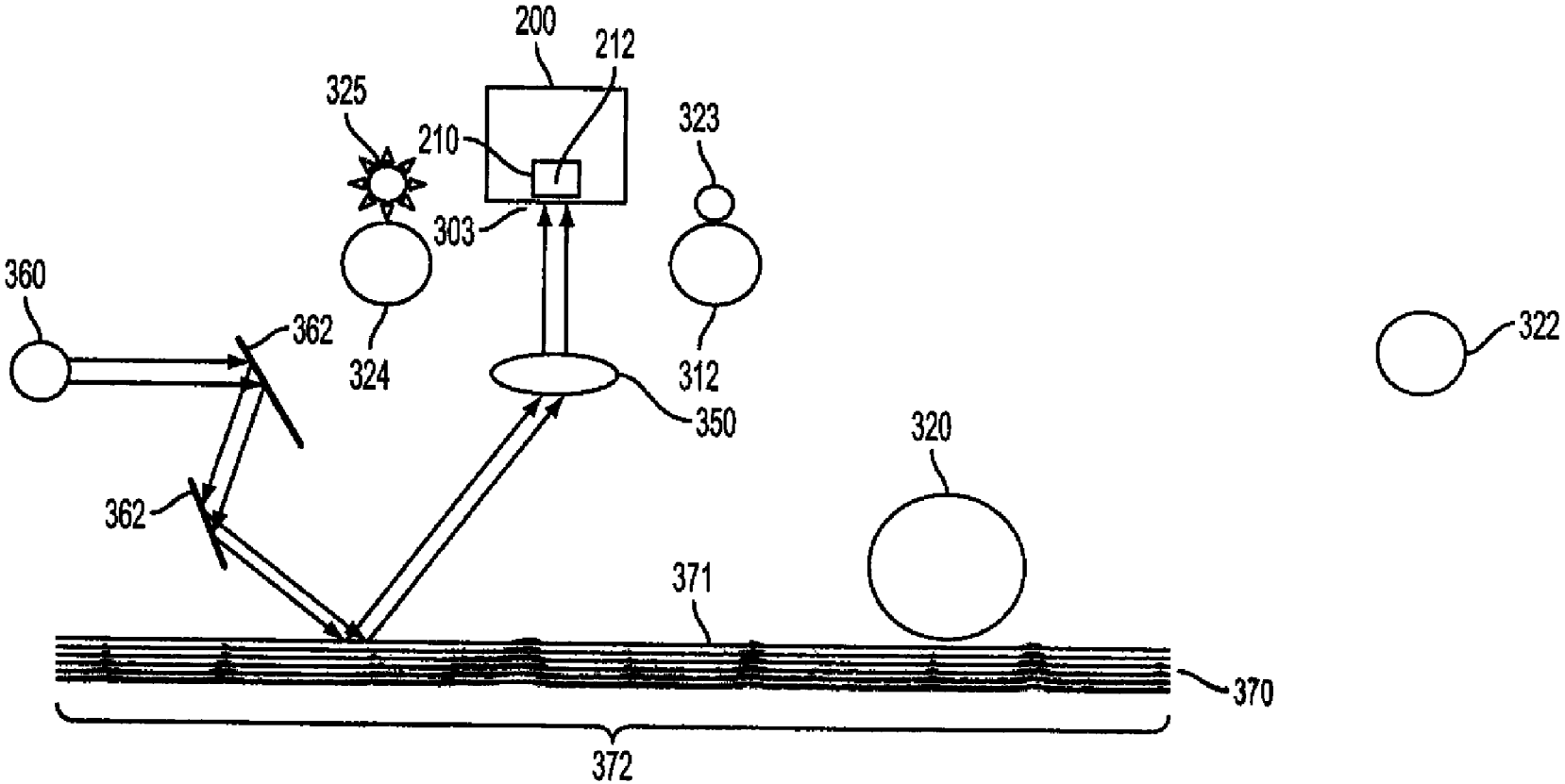
Figure 7:
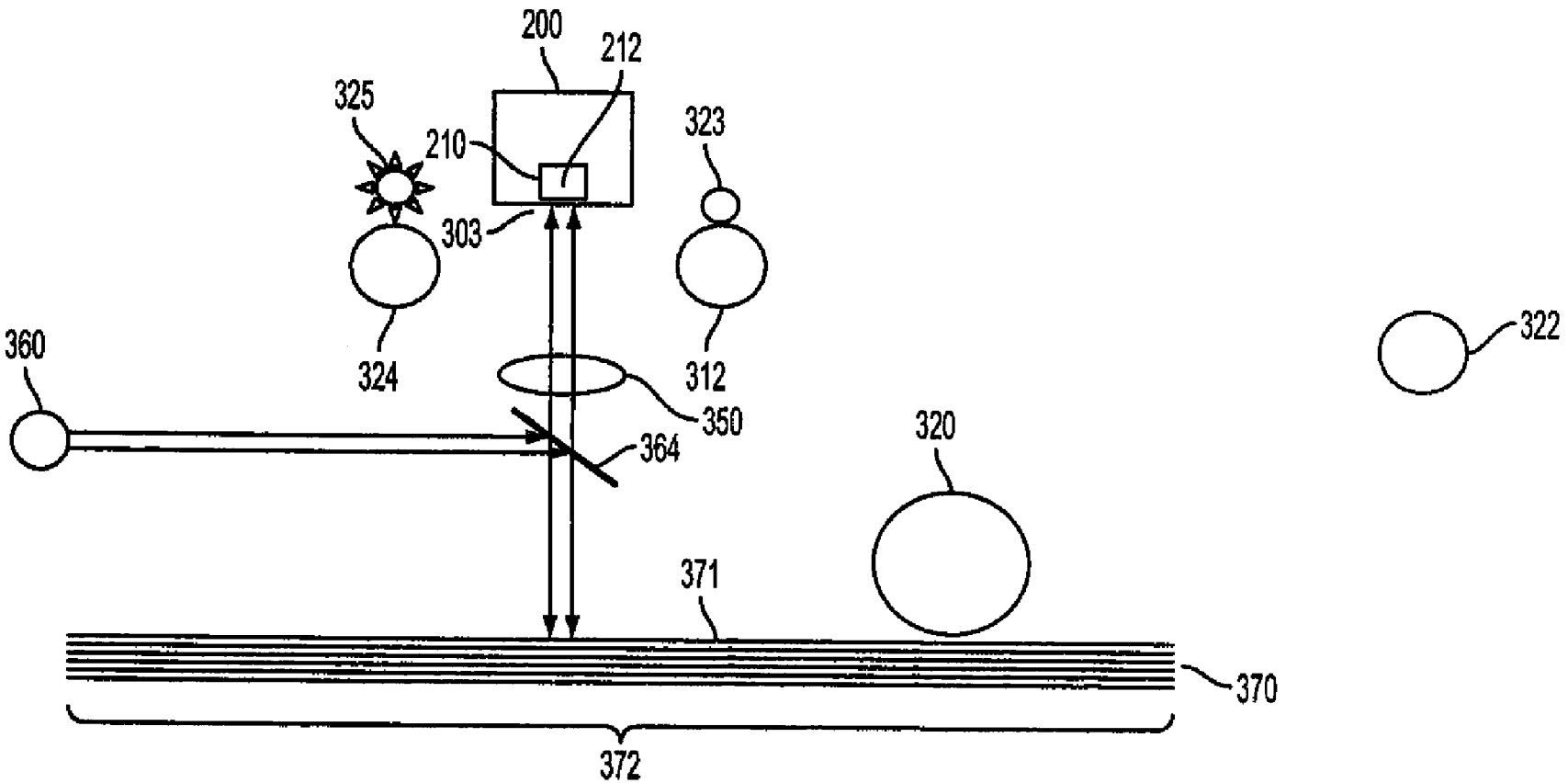

Embodiments of the present invention have one or more optoelectronic devices (a light-emitting device and/or a light-sensing device), mounted on a carriage in a printing system, such that there is an unobstructed optical path between the optoelectronic device and a plurality of regions of the media input location 372 as the carriage is moved along the carriage scan direction 305. FIGS. 5 through 7 show the embodiment of the carriage-mounted optoelectronic device 210 being a photosensor(s) 212 (with the light source 360 stationarily mounted separately from the carriage 200). FIG. 8 shows the embodiment of the carriage-mounted optoelectronic device 210, including both a light source 360 and a photosensor(s) 212.

Figure 11:
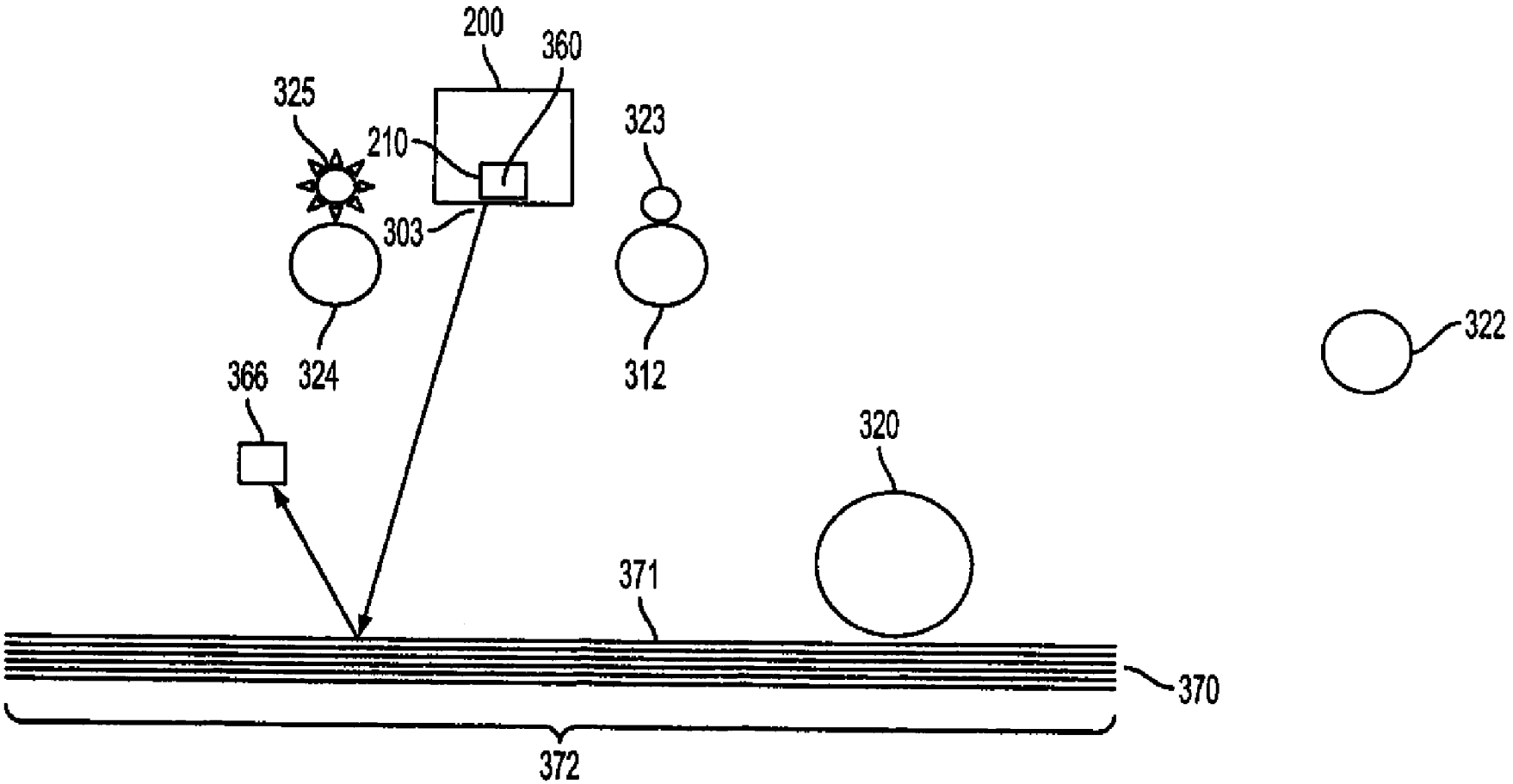
FIG. 11 is a schematic side view of an embodiment of media identification using a light emitter that is mounted on the carriage.

Another embodiment has the light source 360 mounted on the carriage 200, and a photosensor array 366 is stationarily mounted separately from the carriage 200. A schematic side view is shown in FIG. 11, where the photosensor array 366 extends into the plane of FIG. 11, as does the carriage scan direction 305. Light source 360 is activated to provide a narrow impingent beam of light (as indicated by the longer arrow) to the media input location 372, and the narrow beam is reflected from the top sheet of medium 371 (as indicated by the shorter arrow) to one or more photosites on the photosensor array 366. As the carriage 200 moves along the carriage scan direction 305, the reflected light is received at a different set of photosites. The time-varying photosensor signals from the photosensor array 366 are then digitally processed and correlated to impingent beam location through the carriage location provided by encoder fence 383. Variations in the amplitude of the photosensor signal at the different photosites corresponding to different locations of the impingent beam and due to variations of manufacturer's markings in different regions of the recording medium, for example, are then compared to a table of photosensor array signals that correspond to multiple media types in order to identify the type of recording medium in media input location 372. The narrow impingent beam can be provided by collimating the light from light source 360 using optical elements such as lenses, or a laser diode can be used for the light source 360 in this embodiment.

Commonly assigned co-pending U.S. patent application Ser. Nos. 12/332,648, and 12/332,616, disclose different aspects of media sensing at the media input location 372 using photosensor arrays.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzles in first nozzle array
122 Ink delivery pathway (for first nozzle array)
130 Second nozzle array
131 Nozzles in second nozzle array
132 Ink delivery pathway (for second nozzle array)
181 Droplet(s) ejected from first nozzle array
182 Droplet(s) ejected from second nozzle array
200 Carriage
210 Carriage-mounted optoelectronic device (carriage sensor)
211 Frame of carriage sensor assembly
212 Photosensor(s)
213 Bolt
214 Aperture
215 Photosensor lens

216 LED (mounted for diffuse reflections)
217 LED lens
218 LED (mounted for specular reflections)
219 LED lens
221 First type recording medium (first media type)
222 Second type recording medium (second media type)
225 First bar of anchor bar pairs
226 Second bar of anchor bar pairs
228 First identification marks (for first type recording medium)
229 Second identification marks (for second type recording medium)
240 Field of view (ovals)
250 Printhead chassis
251 Printhead die
253 Nozzle array(s)
254 Nozzle array direction
256 Encapsulant
257 Flex circuit
258 Connector board
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction
320 Pick-up roller
322 Turn roller
323 Idler roller(s)
324 Discharge roller
325 Star wheel(s)
330 Maintenance station
350 Lens
360 Light source
362 Mirror(s)
364 Beam splitter
366 Photosensor array
370 Stack of recording media
371 Top sheet of medium
372 Media input location
380 Carriage motor
382 Carriage guide rail
383 Encoder fence
384 Belt
390 Printer electronics board
392 Cable connectors

The invention claimed is:

1. A printing system comprising:

a carriage that is movable along a carriage scan direction;

an optoelectronic device that is mounted on the carriage;

a media input location for storing a recording medium; and at least one unobstructed optical path between the optoelectronic device and a plurality of regions of the media input location as the carriage is moved along the carriage scan direction, wherein the optoelectronic device comprises a light-emitting device that emits light along the at least one unobstructed optical path as the carriage is moved along the carriage scan direction and further comprising a paired light-sensing device that is not mounted on the carriage.

2. The printing system claimed in claim 1, wherein the optoelectronic device comprises:

a light-emitting device;

a light-sensing device; and a package to align the light-sensing device to receive light emitted by the light-emitting device and reflected from the media input location along the at least one unobstructed optical path as the carriage is moved along the carriage scan direction.

3. The printing system claimed in claim 1, wherein the at least one unobstructed optical path includes a lens.

4. The printing system claimed in claim 1, wherein the at least one unobstructed optical path includes a mirror.

5. The printing system claimed in claim 1, wherein the at least one unobstructed optical path includes a beam splitter.

6. The printing system claimed in claim 1, wherein the at least one unobstructed optical path is shielded to block stray light that has not been reflected from the media input location.

7. A method for identifying a type of recording medium that is stored in a media input location of a printing system, the method comprising:

providing a carriage that is movable along a carriage scan direction;

providing an optoelectronic device that is mounted on the carriage;

providing at least one unobstructed optical path between the optoelectronic device and a plurality of regions of the media input location as the carriage is moved along the carriage scan direction;

providing a printing system controller including a table of characteristics of a plurality of recording media types;

activating the optoelectronic device while the carriage is moving along the carriage scan direction in order to provide a time-varying electronic signal corresponding to a plurality of regions of the media input location;

transmitting the time-varying electronic signal to the printing system controller; and comparing the time-varying electronic signal to the table of characteristics for identifying the type of recording medium that is stored in the media input location of the printing system.

8. The method claimed in claim 7, wherein the optoelectronic device comprises a light-emitting device, and the step of activating the optoelectronic device further comprises emitting light from the light-emitting device along the unobstructed optical path toward the media input location and sensing the light with a light-sensing device that is not mounted on the carriage.

9. The method claimed in claim 7, wherein the optoelectronic device comprises a light-sensing device, and the step of activating the optoelectronic device further comprises receiving light from a light source that is not mounted on the carriage and that provides light that is reflected from the media input location along the at least one unobstructed optical path.

10. The method claimed in claim 7, wherein the optoelectronic device comprises a light-emitting device and a light-sensing device, and the step of activating the optoelectronic device further comprises:

emitting light from the light-emitting and device along the unobstructed optical path toward the media input location; and receiving light in the light-sensing device, the received light having been reflected from the media input location along the at least one unobstructed optical path.

11. The method claimed in claim 7, wherein the table of characteristics of the plurality of recording media types includes data corresponding to a plurality of manufacturer's media-type codes.

12. A printing system comprising:

a carriage that is movable along a carriage scan direction;

an optoelectronic device that is mounted on the carriage;

a media input location for storing a recording medium; and at least one unobstructed optical path between the optoelectronic device and a plurality of regions of the media input location as the carriage is moved along the carriage scan direction, wherein the optoelectronic device comprises a light-sensing device that receives light reflected from the media input location along the at least one unobstructed optical path as the carriage is moved along the carriage scan direction and further comprising a paired light source that is not mounted on the carriage.

13. The printing system claimed in claim 12, wherein the at least one unobstructed optical path includes a lens.

14. The printing system claimed in claim 12, wherein the at least one unobstructed optical path includes a mirror.

15. The printing system claimed in claim 12, wherein the at least one unobstructed optical path includes a beam splitter.

16. The printing system claimed in claim 12, wherein the at least one unobstructed optical path is shielded to block stray light that has not been reflected from the media input location.

* * * * *